US011952849B2

(12) United States Patent
Gleason

(10) Patent No.: US 11,952,849 B2
(45) Date of Patent: Apr. 9, 2024

(54) DOWNHOLE SETTING TOOL

(71) Applicant: DBK Industries, LLC, Crowley, TX (US)

(72) Inventor: Brian Michael Gleason, Fort Worth, TX (US)

(73) Assignee: DBK Industries, LLC, Crowley, TX (US)

( * ) Notice: Subject to any disclaimer, the term of this patent is extended or adjusted under 35 U.S.C. 154(b) by 90 days.

(21) Appl. No.: 17/716,966

(22) Filed: Apr. 8, 2022

(65) Prior Publication Data

US 2023/0323747 A1 Oct. 12, 2023

(51) Int. Cl.
*E21B 23/06* (2006.01)
*E21B 33/12* (2006.01)

(52) U.S. Cl.
CPC ..... *E21B 23/065* (2013.01); *E21B 33/12* (2013.01)

(58) Field of Classification Search
CPC ..... E21B 23/065; E21B 33/12
See application file for complete search history.

(56) References Cited

U.S. PATENT DOCUMENTS 541,699 A * 6/1895 Stevenson ..... E21B 27/00 166/99
1,021,205 A * 3/1912 Millis ..... E21B 23/01 166/216
1,414,531 A * 5/1922 Straight ..... E21B 31/20 294/86.25
1,448,112 A * 3/1923 Gibbs ..... E21B 4/08 175/305
1,607,732 A * 11/1926 Fletcher ..... E21B 29/002 407/53
2,807,325 A * 9/1957 Webb ..... E21B 23/065 166/134
4,221,549 A * 9/1980 Rizzone ..... E21B 17/00 74/590
5,024,270 A 6/1991 Bostick
7,017,672 B2 3/2006 Owen
9,810,035 B1 11/2017 Carr et al.
2007/0089911 A1* 4/2007 Moyes ..... E21B 23/04 175/93
2019/0106956 A1* 4/2019 Wells ..... E21B 33/12
2020/0032601 A1* 1/2020 Nguyen ..... C06B 25/34
2020/0115979 A1* 4/2020 Mickey ..... E21B 23/065
2020/0362652 A1* 11/2020 Eitschberger ..... E21B 23/06
2021/0340829 A1* 11/2021 Watkins ..... E21B 23/065

OTHER PUBLICATIONS

Product Sheet for DS MicroSet, DynaEnergetics, https://www.dynaenergetics.com/-/media/Project/DMC/DynaEnergetics/Resource-Files/DS-Microset_DS-Liberator_Product-Sheets.pdf, 4 pages.

* cited by examiner

*Primary Examiner* — Steven A MacDonald
(74) *Attorney, Agent, or Firm* — Johnston IP Law, PLLC

(57) ABSTRACT

A setting tool for use in wells includes a mandrel formed with an interior combustion chamber. The setting tool further includes a barrel piston sized and configured to extend at least partially over an exterior of the mandrel and a shear device coupled to a portion of the mandrel and coupled to the barrel piston when in an in-line configuration. The mandrel includes an upper portion having a lead portion, an engagement portion, and a wrench-application portion. The wrench-application portion has a longitudinal length in the range of 1.5 to 3.0 to receive a wrench and avoid damage to the shear device. Other tools are disclosed.

22 Claims, 5 Drawing Sheets

DOWNHOLE SETTING TOOL

TECHNICAL FIELD

This application is directed, in general, to downhole oil tools, and more specifically, to downhole setting tools for setting frac plugs, bridge plugs, and packers for sealing well casings.

BACKGROUND

Oil and gas wells are drilled into earth formations by first creating a borehole and then running and cementing casing in the borehole. Well tools such as bridge plugs, packers, cement retainers, and frac plugs are often run into cased wells and set using setting tools powered by flammable power charges. Conventional well tools providing well casing sealing assemblies typically include a packer having one or more elastomeric sealing elements that are squeezed between a packer mandrel and the casing. They are held in place by one or more slip assemblies that are wedged between conical sleeves of the packers and the casing. The packers are configured for use as bridge plugs, tubing packers, cement retainers, and frac plugs.

During setting of a casing seal device, a shear device will be sheared to release the setting tool from the set well tool so that the setting tool may be retrieved from the well and be redressed for repeated later use. Increased expenses and delays may result if the shear device is damaged before use.

SUMMARY

According to an illustrative embodiment, a gas-operated setting tool for use in oil wells includes a mandrel having an upper portion and lower portion and having a barrel piston having a first end and a second end. The barrel piston extends over at least a portion of the mandrel when in an in-line configuration and is releasably coupled in a relative position to the mandrel when in the in-line configuration by at least one shear screw. The mandrel has a first end on the upper portion and a second end on the lower portion. The upper portion of the mandrel proximate to the first end is formed with an exposed portion. The exposed portion of the mandrel at the first end of the mandrel extends beyond the first end of the barrel piston.

The exposed portion includes a lead portion, an engagement portion, and a wrench-application portion. The lead portion is formed closer to the first end of the mandrel than to the engagement portion and the wrench-application portion. The engagement portion includes engagement threads or engagement coupler for mating with another device and is closer to the first end of the mandrel than the wrench-application portion. A longitudinal length of the wrench-application portion is in the range of 1.5 to 3.5 inches.

According to another illustrative embodiment, a setting tool for use in wells includes a mandrel having a first end and a second end. The mandrel is formed with an interior combustion chamber. The setting tool further includes a barrel piston sized and configured to extend at least partially over an exterior of the mandrel and a shear device coupled to a portion of the mandrel and coupled to the barrel piston when in an in-line configuration. The mandrel includes an upper portion having a first end and a lower portion having a second end. The upper portion of the mandrel proximate to the first end includes a leading portion, an engagement portion, and a wrench-application portion. The wrench-application portion has a longitudinal length in the range of 1.5 to 3.0 inches.

According to an illustrative embodiment, a method of manufacturing a setting tool for use downhole includes forming a mandrel having an upper portion and lower portion. The mandrel has a first end and a second end. The method further includes forming a barrel piston sized and configured to extend over an exterior of the mandrel and forming a lead portion on the upper portion of the mandrel proximate the first end, wherein the leading portion comprises seal grooves for receiving O-rings. The method also includes forming an engagement portion on the upper portion of the mandrel adjacent to the lead portion and closer to the second end of the mandrel than the lead portion. It also includes forming a wrench-application portion on the upper portion of the mandrel adjacent to the engagement portion and closer to the second end of the mandrel than the engagement portion. The method further involves forming a retaining cap sized and configured to extend over a portion of the exterior of the mandrel, coupling the retaining cap to a first end of the barrel piston, and disposing the retaining cap and barrel piston over a portion of the exterior of the mandrel. The method also includes forming a first shear-device hole in a portion of the upper mandrel for receiving a shear device, forming a second shear-device hole through the barrel piston and in alignment with the first shear device hole when the setting tool is in an in-line configuration, and disposing a shear device in the shear-device hole. Other disclosed setting tools and methods are presented further below.

DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
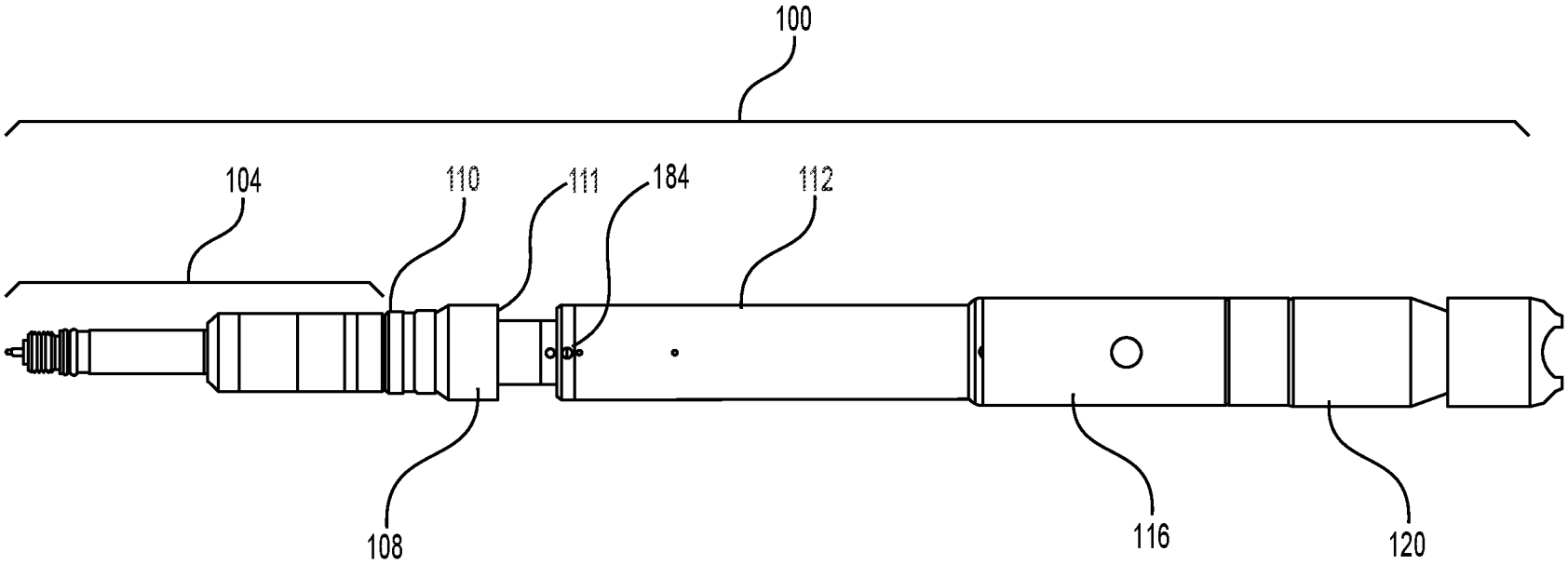
FIG. 1 is a schematic, elevation view of an illustrative embodiment of a bottom hole assembly including an illustrative embodiment of an enhanced setting tool.

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity.

Plugs may be used in a well for many different reasons. For example, frac and bridge plugs may be used to isolate zones in a well. Plugs are typically placed in position using a setting tool. The frac plug is coupled to the setting tool and then run downhole or conveyed on wireline, coiled tubing, jointed pipe, or other conduit. The process can be involved and failures can be expensive causing considerable delay.

As a more detailed example, in the fracking process, after a horizontal well is drilled and cased, perforating guns conveyed on wire line or coiled tubing are fired in the horizontal section of the well. Once the perforated guns are fired and pulled out, the first stage is fractured. After that, it is desirable to isolate an upstream portion—above the previously perforated portion—and this is done by placing a frac plug. The frac plug with a setting tool is conveyed into the well as part of a bottom hole assembly (BHA) to the desired depth. On depth, the firing head is activated by an electrical current from a wireline truck that activates an igniter in the firing head to then cause the power charge in a setting tool to activate. That in turn motivates movement of a barrel piston or other parts that ultimately causes the frac plug to be sealed in the casing. The second zone is then treated and so forth until all the zones are perforated as desired. If the setting tool or any aspect of the BHA fails, it causes delays and increased expense. There are other examples of plugs with which the current disclosed setting tools may be used.

One persistent and serious problem has to do with attaching the setting tool to the firing head or other aspects of the bottom assembly without damaging the components of the setting tool. Illustrative embodiments of the present disclosure present a setting tool that is less prone to failure by way of increasing more reliable and consistent handling by workers in the field. Moreover, the illustrative embodiments also increase the volume of an interior combustion chamber as will be explained further below.

Referring now to the figures and initially and primarily to FIG. 1, an illustrative embodiment of a bottom hole assembly (BHA) 100 is shown. The upper most component of the bottom hole assembly 100 as shown is a quick change 104. Coupled to the quick change 104 is a firing head 108, which has a first end 110 and a second end 111. Next, an illustrative embodiment of a setting tool 112, e.g., a gas-operated setting tool is attached to the firing head 108. The setting tool 112 is coupled to a wireline adapter kit 116 (or running gear). The wireline adapter kit 116 is coupled to a plug 120, e.g., a fracking plug or bridge plug or other downhole plug.

Figure 2:
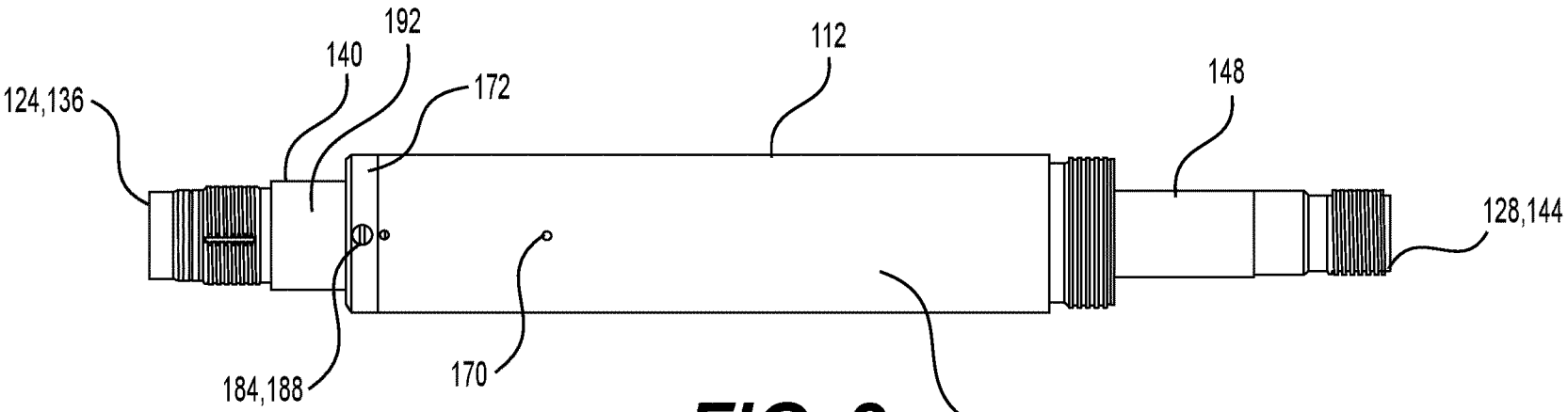
FIG. 2 is a schematic, elevation view of an illustrative embodiment of an enhanced setting tool.
Figure 3:
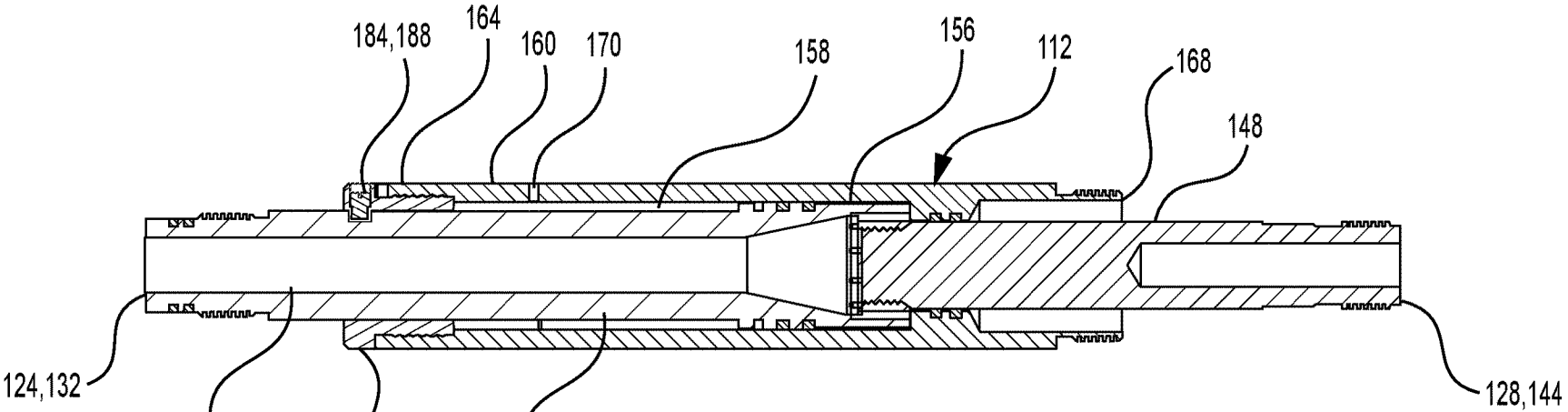
FIG. 3 is a schematic cross section view of the enhanced setting tool of FIG. 2.
Figure 4:
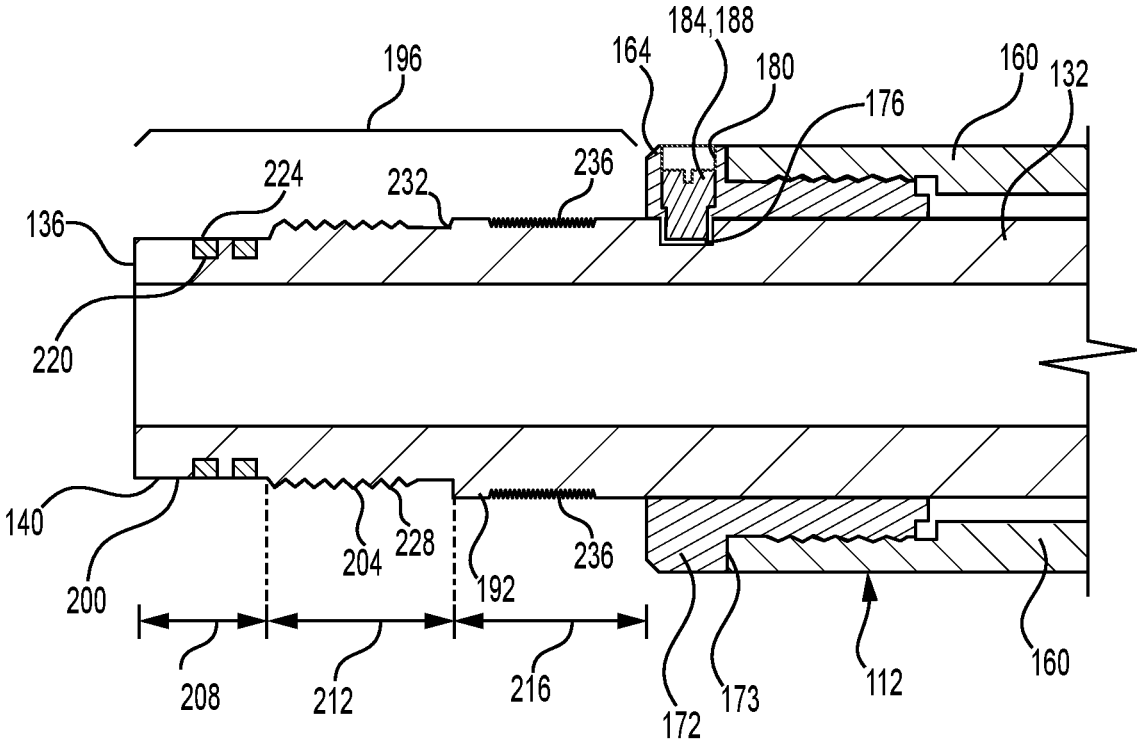
FIG. 4 is a schematic cross of a detail of the first end of the enhanced setting tool of FIG. 3.

Referring now primarily to FIGS. 2-4, an illustrative embodiment of the setting tool 112 is presented in more detail. The setting tool 112 has a first end 124 and a second end 128. The setting tool 112 includes a mandrel 132 having a first end 136 on an upper portion 140 and having a second end 144 on a lower portion 148. The mandrel 132 is formed with an interior combustion chamber 152, which holds a power charge (not explicitly shown).

Around at least a portion of an exterior 158 of the mandrel 132 is a barrel piston 160. The barrel piston 160 has a first end 164 and a second end 168. The barrel piston 160 may be formed with one or more bleed holes, or pressure vents 170. A retaining cap or ring 172 also goes around the exterior 158 of the mandrel 132 and is coupled to the first end 164 of the barrel piston 160. For purposes of this disclosure, the retaining cap 172 may be regarded as a portion of the barrel piston 160. A first shear-device hole 176 is formed in a portion of the mandrel 132 and lines up with a second shear-device hole 180 formed in the barrel piston 160 and more precisely in the retaining cap 172. In preparing the setting tool 112, a shear device 184, e.g., shear screw 188 (set screw) or shear pin, is disposed in the first shear-device hole 176 and second shear-device hole 180 to releasably couple the barrel piston 160 and mandrel 132 and hold them 160, 132 in relative position while in the in-line configuration as shown. In some embodiments, the shear device 184 is a brass shear screw 188.

When the power charge in the combustion chamber 152 is activated, gases expand into an expansion chamber 156 (FIG. 3) creating forces urging the mandrel 132 and the barrel piston 160 apart; when the forces exceed a threshold, the shear device 184 shears releasing the barrel piston 160 to move relative to the mandrel 132. The movement of the barrel piston 160 activates aspects of the plug 120 (FIG. 1) to deploy the plug 120.

Referring primarily to FIG. 2, a significant issue is explained in context. When a field worker goes to attach the first end 124 of the setting tool 112 to the second end 111 of the firing head 108 and needs to apply torque with a wrench, without a wrench-application portion 192 on the setting tool 112, the field worker often positions the wrench on the shear device 184 (or the cap/barrel piston, which holds the shear device) of the setting tool 112 and damages the shear device 184. The damage may cause premature failure during deployment or failure even before introduction. In any event, the damage to the shear device 184 is a significant issue.

Referring again primarily to FIGS. 2-4, to help avoid damage to the shear device 184, the mandrel 132 is formed proximate the first end 124 with the wrench-application portion 192. The wrench-application portion 192 provides space for a wrench to be applied near where the firing head 108 is being applied and clear of the shear device 184. An illustrative embodiment of this portion is shown clearly in FIG. 4.

As shown best in FIG. 4, the upper portion 140 of the mandrel 132 proximate to the first end 136 is formed with an exposed portion 196. The exposed portion 196 of the mandrel 132 at the first end 136 of the mandrel 132 extends beyond the first end 164 of the barrel piston 160 (or the retaining cap 172 as shown). The exposed portion 196 includes a lead portion 200, an engagement portion 204, and the wrench-application portion 192. The lead portion 200 has a longitudinal length 208. The engagement portion 204 has a longitudinal length 212. The wrench-application portion 192 has a longitudinal length 216. Note that the additional length, longitudinal length 216, adds volume to the interior combustion chamber 152. In one illustrative embodiment, the overall length of the setting tool 112 is in the range of 25-35 inches; the longitudinal length 208 is in the range of 1.0-1.5 inches; the longitudinal length 212 is in the range of 1.25-2.0 inches; and the longitudinal length 216 is in the ranges of 1.5 to 3.5 inches. In another illustrative embodiment, the longitudinal length 216 of the wrench-application portion 192 is between 1.75 and 2.25 inches. In one illustrative embodiment, a longitudinal length of the interior combustion chamber 152 is between 10 and 12% longer than the interior combustion chamber 152 would be without the wrench-application portion 192. Those skilled in the art will appreciate that different dimensions may be used in different circumstances.

The lead portion 200 is formed with one or more seal grooves 220 for receiving O-rings 224. Two seal grooves 220 are shown with two O-rings 224. The engagement portion 204 is adjacent to the lead portion 200 and closer to the second end 144 of the mandrel 132 than the lead portion 200. The engagement portion 204 includes threads 228 for engaging with complementary threads on another tool, e.g., the firing head 108, but could include any other fastening means, e.g., click to connect, latch, bolt, screw, or any engagement coupler as those skilled in the art will appreciate. The wrench-application portion 192 is adjacent to the engagement portion 204 and closer to the second end 144 of the mandrel 132 than the engagement portion 204. A step or shoulder 232 may be formed on the mandrel 132 between the engagement portion 204 and the wrench-application portion 192.

The wrench-application portion 192 is for receiving a wrench when a field worker is applying a torque. By directing the field worker to apply the wrench on that portion, the nearby shear device 184 is protected. The wrench-application portion 192 may have any longitudinal length 216 suitable for a wrench to be applied. The wrench-application portion 192 may be formed with a knurled portion 236. The knurled portion 236 may cover all of the wrench-application portion 192 or a portion as shown in FIG. 4. In one illustrative embodiment, the knurled portion 236 comprises between 30 and 90% coverage of the wrench-application portion 192 or any percentage in that range (e.g., 30%, 40%, 50%, 60%, 70%, 80%, 90%, etc.).

Figure 5C:
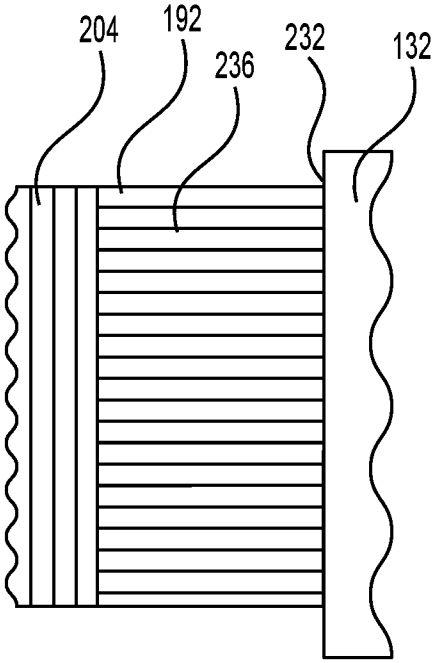
FIGS. 5A-5C are schematic, elevation views of wrench-application portions of illustrative embodiments of enhanced setting tools showing different knurled patterns.
Figure 5B:
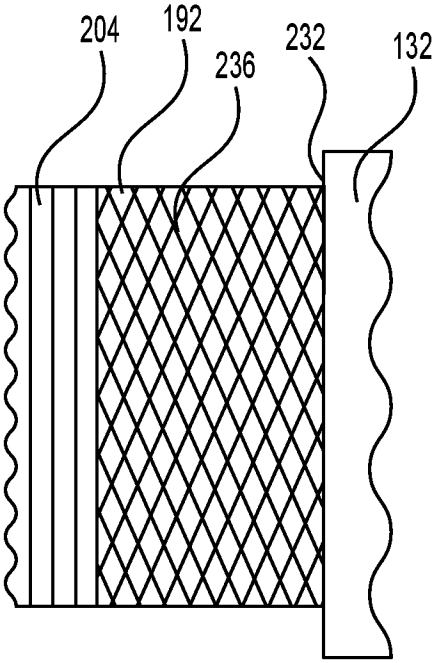
Figure 5A:
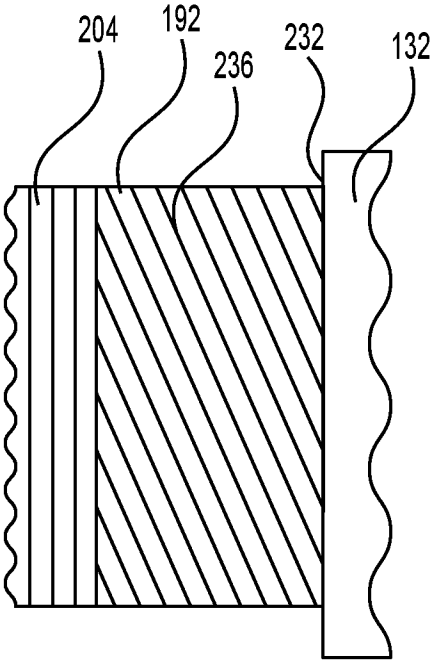
Figure 6:
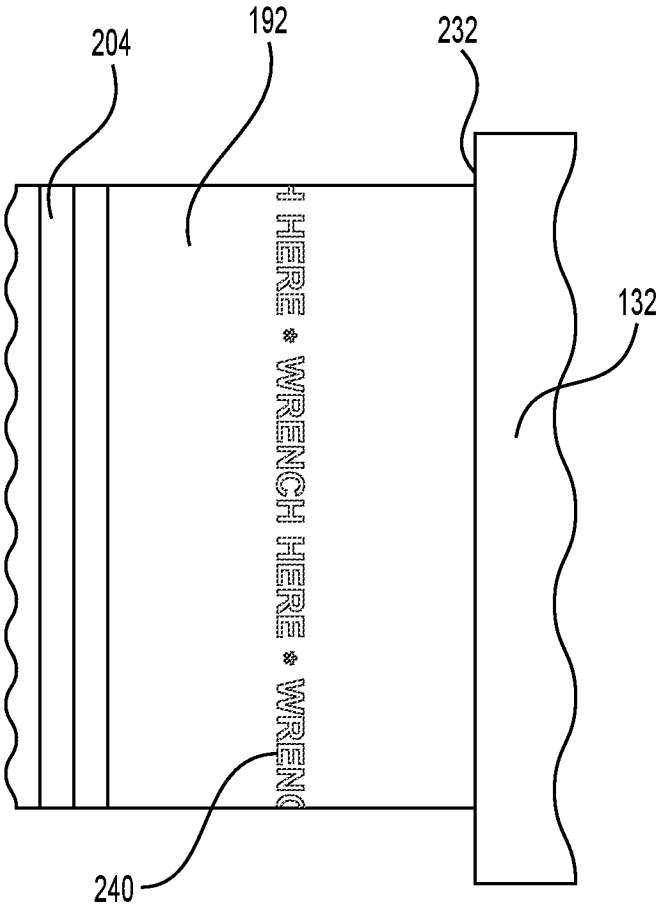
FIG. 6 is a schematic, elevation view of wrench-application portion of illustrative embodiments of an enhanced setting tool showing visual indicia applied thereto.

The knurled portion 236 may have any knurled pattern, e.g., diagonal (see FIG. 5A), diamond (see FIG. 5B), straight (see FIG. 5C), or other pattern. In one illustrative embodiment (see FIG. 6), visual indicia 240 is applied to the wrench-application portion 192. The visual indicia 240 may read, "Wrench" or some other message to suggest application of the wrench. The visual indicia 240 may be applied by paint, adhesive sticker, or any marking technique or may be engraved. In one illustrative embodiment, the visual indicia 240 may be engraved repeatedly to form a knurled pattern of text.

In an alternative embodiment, the wrench-application portion 192 is omitted, but a steel screw or bolt is initially placed in the shear-device apertures 176, 180 that extends beyond the exterior of the setting tool to an extent that the setting tool could not go downhole with the bolt in place. The field worker uses the steel screw or bolt to apply torque. Then, once the firing head or other adjacent device is applied, the steel screw or bolt is replaced with a shear device 184.

According to an illustrative embodiment, a method of manufacturing a setting tool 112 for use downhole includes forming a mandrel 132 having an upper portion 140 and lower portion 148. The mandrel 132 has a first end 136 and a second end 144. The method further includes forming a barrel piston 160 sized and configured to extend over an exterior 158 of the mandrel 132 and forming a lead portion 200 on the upper portion 140 of the mandrel 132 proximate the first end 136. The lead portion 200 includes seal grooves 220 for receiving O-rings 224. The method also includes forming an engagement portion 204 on the upper portion 140 of the mandrel 132 adjacent to the lead portion 200 and closer to the second end 144 of the mandrel 132 than the lead portion 200. The method further includes forming a wrench-application portion 192 on the upper portion 140 of the mandrel 132 adjacent to the engagement portion 204 and closer to the second end 144 of the mandrel 132 than the engagement portion 204.

The method further involves forming a retaining cap 172 sized and configured to extend over a portion of the exterior 158 of the mandrel 132, coupling the retaining cap 172 to a first end 173 of the barrel piston 160, and disposing the retaining cap 172 and barrel piston 160 over a portion of the exterior 158 of the mandrel 132. The method also includes forming a first shear-device hole 176 in a portion of the upper portion 140 of the mandrel 132 for receiving a shear device 184, forming a second shear-device hole 180 through the barrel piston 160 (which in this context includes the retaining cap 172) and in alignment with the first shear-device hole 176 when the setting tool 112 is in an in-line configuration, and disposing a shear device 184 in the shear-device holes 176, 180.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in connection to any one embodiment may also be applicable to any other embodiment.

What is claimed:

1. A gas-operated setting tool for use in oil wells comprising:

a mandrel having an upper portion and lower portion;

a barrel piston having a first end and a second end, and wherein the barrel piston extends over at least a portion of the mandrel when in an in-line configuration and releasably coupled in a relative position to the mandrel when in the in-line configuration by at least one shear screw;

wherein the mandrel has a first end on the upper portion and a second end on the lower portion;

wherein the upper portion of the mandrel proximate to the first end is formed with an exposed portion, wherein the exposed portion of the mandrel at the first end of the mandrel extends beyond the first end of the barrel piston, and wherein the exposed portion comprises a lead portion, an engagement portion, and a wrench-application portion;

wherein the lead portion is formed closer to the first end of the mandrel than to the engagement portion and the wrench-application portion;

wherein the engagement portion comprises an engagement coupler for mating with an another device and is closer to the first end of the mandrel than the wrench-application portion;

wherein a shoulder is formed on the mandrel between the engagement portion and the wrench-application portion and the diameter of the wrench application portion is larger than the diameter of the engagement portion;

wherein the wrench-application portion comprises a knurled portion; and wherein a longitudinal length of the wrench-application portion in the range of 1.5 to 3.5 inches is exposed for application of a wrench when the another device is mated to the engagement coupler.

2. The gas-operated setting tool of claim 1, wherein the shear screw is a brass shear screw.

3. The gas-operated setting tool of claim 1, wherein the engagement portion is sized and configured to mate with a firing head.

4. The gas-operated setting tool of claim 1, wherein the knurled portion comprises a diagonal knurling pattern.

5. The gas-operated setting tool of claim 1, wherein the knurled portion comprises a diamond knurling pattern.

6. The gas-operated setting tool of claim 1, wherein the knurled portion comprises a straight knurling pattern.

7. The gas-operated setting tool of claim 1, wherein the wrench-application portion comprises visual indicia.

8. The gas-operated setting tool of claim 1, wherein the wrench-application portion comprises engraved visual indicia.

9. The gas-operated setting tool of claim 1, wherein the knurled portion comprises one of the group consisting of: a straight knurling pattern, a diamond knurling pattern, a diagonal knurling pattern, a cross knurling pattern, and a helical knurling pattern.

10. The gas-operated setting tool of claim 1, wherein the exposed longitudinal length of the wrench-application portion is in the range of 1.75 to 2.0 inches.

11. The gas-operated setting tool of claim 1, wherein the upper mandrel comprises an interior combustion chamber, and wherein a longitudinal length of the interior combustion chamber is between 10 and 12% longer than the combustion chamber would be without the wrench-application portion.

12. The gas-operated setting tool of claim 1, wherein the lead portion comprises a plurality of seal grooves and concomitant O-rings.

13. A setting tool for use in wells comprising:

a mandrel having a first end and a second end, wherein the mandrel is formed with an interior combustion chamber;

a barrel piston sized and configured to extend at least partially over an exterior of the mandrel;

a shear device coupled to a portion of the mandrel and coupled to the barrel piston when in an in-line configuration;

wherein the mandrel comprises an upper portion having a first end and a lower portion having a second end;

wherein the upper portion of the mandrel proximate to the first end comprises: a lead portion, an engagement thread portion, and a wrench-application portion, wherein a shoulder is formed on the mandrel between the engagement portion and the wrench-application portion and the diameter of the wrench application portion is larger than the diameter of the engagement portion; and wherein a longitudinal length of the wrench-application portion in the range of 1.5 to 3.0 inches is exposed for application of a wrench when an another device is mated to the engagement coupler.

14. The setting tool of claim 13, wherein the wrench-application portion comprises a knurled portion having knurled pattern.

15. The setting tool of claim 13, wherein the wrench-application portion comprises a knurled portion having knurled pattern, and wherein the knurled pattern comprises a diamond knurled pattern.

16. The setting tool of claim 13, wherein the wrench-application portion comprises visual indicia indicating a wrench-application area.

17. The setting tool of claim 13, wherein the shear device is a shear screw.

18. The setting tool of claim 13, wherein the longitudinal length of the exposed wrench-application portion is in the range of 1.75 to 2.0 inches and comprises at least 40% of an overall length of the lead portion, engagement portion, and wrench application portion.

19. A method of manufacturing a setting tool for use downhole, the method comprising:

forming a mandrel having an upper portion and lower portion, wherein the mandrel has a first end and a second end;

forming a barrel piston sized and configured to extend over an exterior of the mandrel;

forming a lead portion on the upper portion of the mandrel proximate to the first end, wherein the leading portion comprises seal grooves for receiving O-rings;

forming an engagement portion on the upper portion of the mandrel adjacent to the lead portion and closer to the second end of the mandrel than the lead portion;

forming a wrench-application portion on the upper portion of the mandrel adjacent to the engagement portion and closer to the second end of the mandrel than the engagement portion, wherein a shoulder is formed on the mandrel between the engagement portion and the wrench-application portion and the diameter of the wrench application portion is larger than the diameter of the engagement portion;

forming a retaining cap sized and configured to extend over a portion of the exterior of the mandrel;

coupling the retaining cap to a first end of the barrel piston;

disposing the retaining cap and barrel piston over a portion of the exterior of the mandrel;

forming a first shear-device hole in a portion of the upper mandrel for receiving a shear device;

forming a second shear-device hole through the barrel piston and in alignment with the first shear device hole when the setting tool is in an in-line configuration; and disposing a shear device in the first shear-device hole and second shear-device hole.

20. The method of manufacturing a setting tool of claim 19, further comprising forming a knurled portion on the wrench-application portion of the mandrel.

21. The method of manufacturing a setting tool of claim 19, wherein forming a wrench-application area on the upper portion of the mandrel comprises forming an elongated area having a knurled pattern.

22. The method of manufacturing a setting tool of claim 19, wherein forming a wrench-application portion on the upper portion of the mandrel comprises forming an elongated area having a knurled pattern, and wherein the wrench-application portion has a longitudinal length between 1.5 and 3.0 inches.

* * * * *